US010238956B2

(12) United States Patent
Litman

(10) Patent No.: US 10,238,956 B2
(45) Date of Patent: Mar. 26, 2019

(54) VERSATILE FANTASY SPORT SCRATCH-OFF TICKET AND METHOD

(71) Applicant: Mark A. Litman, Edina, MN (US)

(72) Inventor: Mark A. Litman, Edina, MN (US)

( * ) Notice: Subject to any disclaimer, the term of this patent is extended or adjusted under 35 U.S.C. 154(b) by 0 days.

(21) Appl. No.: 15/648,451

(22) Filed: Jul. 12, 2017

(65) Prior Publication Data

US 2018/0015360 A1 Jan. 18, 2018

Related U.S. Application Data

(60) Provisional application No. 62/361,939, filed on Jul. 13, 2016.

(51) Int. Cl.
*A63F 3/06* (2006.01)
*A63F 9/24* (2006.01)

(52) U.S. Cl.
CPC ..... *A63F 3/0615* (2013.01); *A63F 3/064* (2013.01); *A63F 3/0665* (2013.01); *A63F 2009/242* (2013.01)

(58) Field of Classification Search
CPC ..... A63F 3/0665; A63F 3/064; A63F 3/0615; A63F 2009/242
See application file for complete search history.

(56) References Cited

U.S. PATENT DOCUMENTS 4,429,877 A * 2/1984 Coppock ..... A63F 3/0665 273/139
4,466,614 A * 8/1984 Bachman ..... A63F 3/0665 273/139
4,491,319 A * 1/1985 Nelson ..... A63F 3/0665 273/139
4,953,873 A * 9/1990 Jacobson ..... A63F 3/00041 273/247
5,092,598 A * 3/1992 Kamille ..... A63F 3/0665 273/139
5,332,218 A * 7/1994 Lucey ..... A63F 3/0615 273/139
5,518,239 A * 5/1996 Johnston ..... A63F 3/0615 273/139
5,671,921 A * 9/1997 Quinlan ..... A63F 3/069 273/139
5,743,524 A * 4/1998 Nannicola ..... A63F 3/069 273/139

(Continued)

*Primary Examiner* — Kang Hu
*Assistant Examiner* — Malina D Blaise
(74) *Attorney, Agent, or Firm* — Mark A. Litman & Associates, P.A.

(57) ABSTRACT

A scratch-off fantasy sport gaming ticket has: a ticket support sheet; two or three distinct regions of images on one side of the ticket support sheet; a first region providing a random distribution of symbols indicating a number of distinct sports events which the ticket can use; a second region of images providing either i) a random distribution of multiple symbols indicating one sports team or player on which the ticket can be used with the number of distinct sports events; a third region providing a random distribution of symbols indicating a sports statistic to be associated with both the multiple symbols indicating the number of distinct sports events and the sports team or player; and each of the two or three visually distinct regions of images have an opaque scratch-off coating over them, or ii) a second region having both events and statistical target in each distinct region.

20 Claims, 5 Drawing Sheets

(56) References Cited

U.S. PATENT DOCUMENTS 6,237,913 B1 * 5/2001 Kamille ..... A63F 3/065 273/138.1
6,612,576 B1 * 9/2003 Stancik ..... A63F 3/069 273/138.1
6,676,126 B1 * 1/2004 Walker ..... A63F 3/0665 273/139
7,458,580 B2 * 12/2008 Martineck ..... A63F 3/0415 273/139
8,523,669 B1 * 9/2013 Krietemeyer ..... A63F 3/06 463/29
8,628,082 B2 * 1/2014 Martineck ..... A63F 3/0665 273/138.1
8,672,325 B2 * 3/2014 Green ..... A63F 3/00157 273/138.1
8,820,744 B1 * 9/2014 Lawton ..... A63F 3/0615 273/139
9,390,591 B2 * 7/2016 Granich ..... G07F 17/3209
9,761,084 B2 * 9/2017 Alexander ..... G07F 17/3244
2001/0019193 A1 * 9/2001 Gumina ..... A63F 1/18 273/139
2003/0224856 A1 * 12/2003 Bukovsky ..... A63F 13/12 463/42
2005/0098950 A1 * 5/2005 Yamaguchi ..... A63F 3/0615 273/269
2005/0167910 A1 * 8/2005 Candler ..... A63F 3/0665 273/138.1
2006/0151944 A1 * 7/2006 Jubinville ..... A63F 3/0605 273/138.1
2008/0015005 A1 * 1/2008 Yaldoo ..... A63F 3/064 463/16
2009/0042631 A1 * 2/2009 Randhawa ..... G07F 17/32 463/17
2009/0093292 A1 * 4/2009 Randhawa ..... G07F 17/32 463/17
2009/0280886 A1 * 11/2009 Randhawa ..... G07F 17/32 463/17
2014/0375045 A1 * 12/2014 Jackson ..... A63F 3/0605 283/67
2015/0317884 A1 * 11/2015 Kadlec ..... G07F 17/3218 463/20
2016/0151702 A1 * 6/2016 Jackson ..... A63F 3/0665 283/94
2017/0053473 A1 * 2/2017 Colvin ..... G07F 17/329
2017/0236364 A1 * 8/2017 Heathcote ..... G07F 17/329 463/20
2018/0001684 A1 * 1/2018 Mitchell, Jr. ..... B41M 3/005

* cited by examiner

VERSATILE FANTASY SPORT SCRATCH-OFF TICKET AND METHOD

RELATED APPLICATION DATA

This Application claims priority from Provisional U.S. Patent Application Ser. No. 62/361,939, filed 13 Jul. 2016 and titled VERSATILE FANTASY SPORT SCRATCHOFF TICKET AND METHOD.

BACKGROUND OF THE INVENTION

1. Field of the Invention

The present invention relates to the field of fantasy sports wagering and in particular to the combination of scratch-off tickets that can be used in fantasy sports games.

2. Background of the Art

Fantasy sports games are ubiquitous in today's society. Leagues associated with fantasy games form in bars, at work, within families, and in neighborhoods and schools. Participants within individual leagues gather prior to the opening of the sports season and draft or auction teams of players. During the season, participants monitor the performance of their players and choose which players to keep active, which players to release, which players to acquire, and which players to trade. Fantasy sports providers generate revenue by providing advertising and/or charging team fees.

Traditional fantasy sports games don't create enough opportunities throughout the season for excitement, risk, and instant gratification—factors that entice the player to play more often. Fantasy sports users get the most excitement out of selecting a roster, making trades, and acquiring new "free agents." However, in traditional fantasy sports games, successful users are typically required to show patience and infrequently manage their roster for at least two reasons: 1) successful users tend to choose good players from the start, so there is little need to improve the players on the roster and 2) successful users understand that too much tweaking of the roster increases risk and limits the beneficial effects of long-term statistical regression to the mean. Even unsuccessful users are unlikely to actively play the game as often as they would like for at least three reasons: 1) the successful users have all the good players and their not willing to part with them, 2) unsuccessful users realize that they can benefit from the long-term statistical regression to the mean by keeping their roster stable, and 3) the likelihood of finding a quality players available or a willing trade partner is slim given that there are only so many real-world players to go around and only so many statistical categories that can be measured.

Since getting users to be actively involved in the game is what generates revenue (via advertising, transaction fees, data collection, related sales opportunities, or pay to play models), maximizing player engagement is good not only for the player, but for the game provider.

Other attempts have been made to increase player involvement: U.S. Pat. No. 6,656,042 describes an interactive fantasy lottery "where lottery players are given game pieces describing discernable actors (people, animals or events) who will be participating in an upcoming event." Lottery players could return to a Web site daily, to receive a new game piece. This gave the player something new every day, and introduced some degree of chance/excitement to obtaining a player, but it completely removed the skill involved in assembling a traditional fantasy roster. U.S. Pat. No. 6,371,855 describes a fantasy Internet sports game "that combines the entertainment of fantasy sports with the excitement of participating in an economic venture" by awarding value points based not only on player performance but on the value of those players. This invention rewarded a sophisticated assessment of risk and reward in assembling a roster, but it removed the excitement that comes from a more dynamic roster and the element of chance. In the field of lottery tickets, U.S. Pat. No. 5,887,906 describes combining the instant feedback of a scratch ticket with the personal intuition and ritual of playing one's numbers in a weekly lottery.

Published US Patent Application Document 20110021262 (Wikander) discloses a sports fantasy game, having a roster of fantasy players for each user, and a slot machine-like apparatus that provides a limited number of spins for randomly populating the roster of fantasy players. Also disclosed herein is a method of conducting the above described game. Further described and claimed are various modifications and enhancements.

Published US Patent Application Document 20140123464 (Martineck) discloses a lottery instant-game ticket and method of making same. On a substrate is placed a first set of game indicia including a first set of game symbols, and a second set of indicia larger than the first set of game indicia and including a second set of game symbols, and includes any winning symbol. A subset of the second set of game indicia with each symbol including a non-winning indicator. The first set and second of game indicia are covered with a removable covering, with the covering having position indicators positioned substantially over each of the first set of game indicia, and identical game symbols positioned substantially over a corresponding identical game symbol of the second set of game indicia such that removal of the identical game symbol reveals the identical game symbol of the second set of game indicia and any non-winning indicator, if present.

Published US Patent Application Document 20130337883 (Stanek) discloses a method and associated lottery game card/ticket provided for implementing a ticket-based, multi-component lottery game and includes providing lottery tickets for players, wherein the lottery tickets include a first game component with a first prize structure and at least one additional game component with a separate second prize structure. A first validation code is provided on the lottery ticket that is linked to a first game server for validating and redeeming the first game component of the lottery ticket. A second validation code is provided on the lottery ticket that may be linked to a separate second game server for validating and redeeming the second game U.S. Pat. No. 4,634,149 (Donovan) describes a label comprises a plurality of separate first indicia printed on one side thereof with each camouflaged by an opaque layer. The indicia representing numbers are segregated in a grid pattern. The first indicia represent possible chip positions when betting on a game of roulette. The label also has second indicia comprising a perspective view of a roulette wheel and a predetermined number of first indicia representing the equivalent or bets. To play, the label is cut or torn for removal from the exterior of a container to expose the first and second indicia, enabling a player to remove desired portions of the camouflaged layer to reveal first indicia numbers corresponding to the second indicia numbers.

The security of contest cards and the like have been the subject of previous patents including U.S. Pat. Nos. 2,764, 821; 2,961,777; 2,986,820; 3,055,117; 3,508,344; 2,210,897; 3,823,022; 2,410,800; 3,877,155. While these patents have increased the security of contest cards and produced acceptable solutions to problems encountered, they have not provided the answer to more sophisticated methods of compromise. One particular technique has been developed recently wherein previously secure lottery tickets can be photocopied on a conventional photocopy machine, and the resulting paper photocopy will show the printed indicia in readable form and the opaque mask on the ticket will not be altered to any recognizable degree. Tickets produced according to the previous patents have been subjected to this method of compromise and have been found to be insecure.

U.S. Pat. No. 4,241,942 (Bachman) describes a secure contest card which is not susceptible to compromise by both simple and sophisticated techniques comprises printed indicia disposed on the upper surface of card stock material, a patterned intermediate layer disposed over the printed indicia and an opaque removable mask disposed over the intermediate layer and over the printed indicia. In a second embodiment of the invention a patterned background layer is disposed between the card stock and the printed indicia and the patterned intermediate layer is eliminated. In a third and preferred embodiment, the patterned background layer and the patterned intermediate layer are both employed. It has been found that the pattern in the background and intermediate layers creates an irregular relationship with the indicia and defeats certain new techniques for compromise of apparently secure contest cards.

U.S. Pat. No. 4,191,376 (Goldman) describes tickets for an instant lottery that are imprinted with lottery numbers and serial numbers that are uniquely related and the lottery numbers are covered from view until after purchase, to provide control and distribution of winners and a high degree of security from fraud. By means of computerized fabrication a low cost and high security ticket is achieved. Playing cards for other games are also inexpensively fabricated.

U.S. Pat. No. 4,299,637 (Oberdeck) describes a method for making a game ticket, such as for example a lottery ticket, is disclosed in which the ticket has a base sheet and a cover sheet adhesively joined together in peripheral portions of sections containing information used in the game. The cover sheet, along with other materials placed on the base sheet, conceals the information to be used in the game and prevents undetected tampering with the ticket. The ticket is formed from a base sheet on which information to be concealed is printed, and a release coating is deposited over predetermined areas of the previously printed information. Thereafter an opaque material is applied over the release coating to conceal the information in the printed areas, which opaque material is adapted to be rubbed off when the ticket is used. Thereafter the non-transparent cover sheet is adhered to the base sheet along predetermined areas surrounding the sections of the base sheet defining individual tickets.

All documents referenced to herein are incorporated in their entirety herein.

Fantasy sports wagering is intimidating to many individuals, and the categorization by legal jurisdictions of Fantasy Wagering as a skill-based exercise, has not helped bring in new players. It is desirable to provide a new fantasy Sports system that allows all individuals to feel as if they have an equal chance of winning, even without a significant level of knowledge or skill in the sports events.

SUMMARY OF THE INVENTION

A scratch-off fantasy sport gaming ticket has at least:

a) a ticket support sheet;

b) two or three distinct regions of images on the ticket support sheet;

c) a first region of images providing a random distribution of multiple symbols indicating a number of distinct sports events on which the ticket can be used;

d) a second region of images providing a random distribution of multiple symbols indicating at least one sports team or player on which the ticket can be used in combination with the number of distinct sports events;

e) the second or a third region of images providing a random distribution of multiple symbols indicating a sports statistic to be associated with both the random distribution of multiple symbols indicating the number of distinct sports events and the at least one sports team or player.

Each of the two or three distinct regions of images has an opaque scratch-off coating over the images, and each of the three regions have visually distinct opaque scratch-off coatings so that each one of the multiple symbols within the three distinct regions has a distinct area over each of the multiple symbols within the three distinct regions, so that individual ones of the multiple symbols can be scratched-off without exposing unintended numbers of the multiple symbols when scratching-off only one intended distinct area of a coating to expose only a single one of the multiple symbols at a single time.

DETAILED DESCRIPTION OF THE INVENTION

Figure 1:
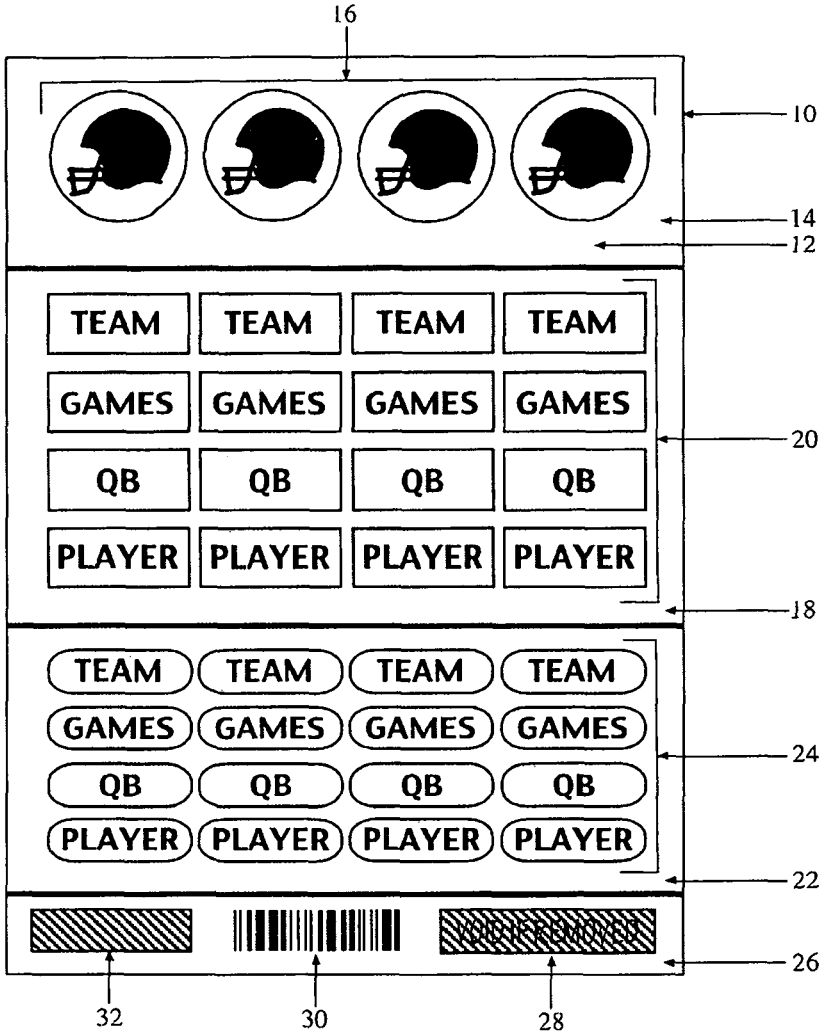
FIG. 1 is a full face view of a fantasy sport gaming ticket according to the present technology before any opaque covering has been removed.

A scratch-off fantasy sport gaming ticket may include:

a) a ticket support sheet;

b) two distinct regions of images on one side of the ticket support sheet;

c) a first region of images providing a random distribution of multiple symbols indicating a specific whole integer number of distinct sports events on which the ticket can be used;

d) a second region of images providing a random distribution of multiple symbols indicating both A) at least one sports team or player on which the ticket can be used in combination with the number of distinct sports events and B) a sports statistic to be associated with the one sports team or player; and wherein each of the two distinct regions of images have an opaque scratch-off coating over them, and each of the two distinct regions of images have visually distinct opaque scratch-off coatings so that each one of the multiple symbols within the two distinct regions has a distinct area over each of the multiple symbols within the two distinct regions, so that individual ones of the multiple symbols can be scratched-off without exposing unintended numbers of the multiple symbols when scratching-off only one intended distinct area of the opaque scratch-off coating to expose only a single one of the multiple symbols at a single time.

The ticket may have the one side of the ticket with visual symbol indication of a single specific type of sport event to which the ticket is relevant, and that visual symbol indication is not removed during scratching off of opaque scratch-off coatings over distinct areas of each of the multiple symbols within the two distinct regions.

The ticket may be provided with the second distinct region containing at least two distinct areas having within each distinct area combinations of events and statistics selected from the group consisting of (with respect to a football sports fantasy ticket) a team and total score in a game for that team; a team and total touchdowns for that team in a game; a team and total rushing touchdowns for that team in a game; a team and total passing touchdowns for that team in a game; a team and total field goals for that team in a game; a quarterback and total touchdowns by that quarterback in a game; a quarterback and total passing yards for that quarterback in a game; a running back and total touchdowns for that running back in a game; a running back and total yards fir that running back in a game; a running back and total yards for that running back in a game; a pair of teams in a game with a point spread difference between the two teams in that game; a pair of teams in a game and a total point count for the two teams in that game; a pair of teams in a game and a total number of touchdown scored for the two teams in that game; a pair of teams in a game and a total number of rushing touchdown scored for the two teams in that game; a pair of teams in a game and a total number of passing touchdown scored for the two teams in that game; and a pair of teams in a game and a total number of kicking points scored for the two teams in that game.

Again, although football is being used as a primary example, other sports events can be used with parallel statistics. In baseball, hockey and basketball, total points for a single team, combined points for two teams, home runs, team batting average, percent field goal percentage, three-point goals, individual player statistics, saves, blocked shots, assists and the like may be statistical categories. The number revealing symbols may be a football helmet (as in FIG. 1), baseball cap, baseball glove, football, hockey helmet, hockey puck, baseball, basketball, basket and the like.

An alternative scratch-off fantasy sport gaming ticket has at least:

a) a ticket support sheet. The ticket support sheet may be a sheet, film, card, or other layer made of paper, fabric, polymeric material, composition or any other structural material.

b) three distinct regions of images on the ticket support sheet. The three distinct regions may be in dedicated vertical areas, dedicated horizontal areas, in patterned arrays, or may even extend into and through other areas, while remaining distinct. For example, there may be six horizontal stripes of the three distinct areas, with alternating areas for each dedicated region.

c) a first region of images providing a random distribution of multiple symbols indicating a number of distinct sports events on which the ticket can be used.

For example, there may be at least two, up to sixteen distinct scratch-off areas having a random distribution of at least two different numbers and up to sixteen different numbers of a card. For example, if the card were dedicated to college football, there are easily over fifty games each Saturday during the height of the season. Therefore the card may allow from 1 to 16 different games to be required to be played on the single card, depending on the number revealed by scratching off the single area allowed to be scratched off in this region of game play. The random numbers need not cover the entire range of potentially available games, and can be no greater than the number of available symbols in the second range. For example, if there were 16 available events in the second region, the hidden numbers for games to be played could be and combination of numbers between 1 and 16, and might be distributed such as (with five numbers hidden) 1-game, 2-games, 4-games, 6-games and 10-games; or 1-game, 1-game, 3-games, 3-games and 5-games; 1-game, 2-games, 2-games, 2-games and 4-games; etc.

Once any area has been scratched-off so as to expose any part of a hidden image, that displayed symbol must be in play. With respect to the first symbol determining the number of games active in the fantasy game play, if more than one area has been scratched-off, that ticket is void and no refund or award is available.

d) a second region of images providing a random distribution of multiple symbols indicating at least one sports team or player on which the ticket can be used in combination with the number of distinct sports events.

If, by way of non-limiting example, a scratch-off in the first area has revealed a number 3, meaning three games must be in play, exactly three symbols in the second area must be exposed as these determine the specific sports event in play. For example, if college football games were the content of the fantasy sports card, three of the distinct areas must be scratched off to reveal which team, or which game (two teams) is one of the three sports events in play. If more than three (the number of events required and allowed in the activity of the card) symbols are revealed by scratch-off, then the ticket is void and no awards can be made. Both teams and games may be indicated by words, symbols, numbers key-coded to games or any other symbol that indicates which team or game is in play. It is preferable that the order of the teams revealed be used in the play of the card. For example, counting across a top row of second game symbols (left-to-right), there could be four available spaces, as in a second, third and fourth row (thereby providing 16 symbols). Play may require a pick in each row for the number of picks available, so that if three games were required to be played by selection of a 3 in the first region of symbols, one pick each might be required from only rows 1, 2 and 3. Alternatively, the games are assigned virtual numbers upon revelation so that reading the available spaces as sentences in a book, from left to right on the top row, then moving left to right on the next row, the games would be nominally considered as 1, 2, 3, 4, . . . 16 for the four-by-four rows/columns of available symbols. This becomes important in associating the symbols of the third area (the achievement level, spread, statistic challenge, etc.) with a specific team, specific game or even player (if the second area identifies individual players or positions). For example, in college football, a second region symbol might indicate running backs for Penn State, and the third region could be designed to allow picking random yardage that must be exceeded by the total number of running backs played by Penn State in a particular game. Similarly, if the disclosed player were QB Florida State, the revealed pick from the third area could be percent completions, total yardage, touchdowns, interceptions, ration of touchdowns to interceptions, etc.

Similarly, if a game or a team were picked, the third region might conceal random point spreads, amount of points scored by an individual team, amount of points allowed by a team, etc. These statistical challenges can be incorporated into region three so that a variety of different statistical events can be executed and not only point spread for a particular game.

For example, if the random symbols selected from region 2 included a specific game, a QB, a running back and total score in a game, there could be four or more columns in the third region, each column dedicated to point spreads for a game (generic spread, not dedicated to a specific game), QB statistics (e.g., total number of passes, completion percentage, total passing yardage, number of touchdowns, etc.), running backs (e.g., total carries, total running yards, total combined yards, touchdowns, etc.), receivers (e.g., total number of receptions, total receiving yards, total combined yards, number of touchdowns, etc.), and Total Offense (e.g., number of points, number of rushing points, number of kicking points from field goals and extra point, number of receiving points, etc. Thus if one QB were picked, one number from the QB statistics column would be picked. If two QBs were picked in the scratch-off in the second region, then game play might allow either QB statistic picked from the third region to be used once in reading outcomes from the cards, or the first QB in the order of symbols in the columns and rows would be matched with the first QB statistic picked in the third region, and the second QB picked in the second region would be matched with the second QB statistic in the third region. These rules of comparison would be part of the contract, rules of play for the scratch-off card.

For example, if the first ordered QB picked was Penn State QB and the second ordered QB picked was Cornell QB, and the first ordered QB statistic picked from region three from the QB column was 178 yards, and the second ordered QB statistic was 67% completion rate, to be a winning combination on a single event on the card, the Penn State QB must pass and run for at least 178 yards, and the Cornell QB must have a completion percentage of at least 67% for that event to be winning combination.

The paytable on the scratch-off cards would be dependent on the number of events and the number of winning events. For example, with a single event randomly selected in scratch-off in region one, the payout may be (by way of non-limiting example) 1× to 4× the card cost. With two events randomly chosen in region one, the payout for one winning combination may be zero and for two winning outcomes, the payout may be 2× to 10× the card cost. With three events randomly chosen in region one, the payout for one winning combination may be zero, for two winning events may be 1× to 2× and for three winning outcomes, the payout may be 5× to 20× the card cost. For a maximum event selection of 16 game events selected from Region one, there could be a payout beginning at eight correct events, with a maximum payout of 5000× (or more) for getting sixteen correct.

e) a third region of images providing a random distribution of multiple symbols indicating a sports statistic to be associated with both the random distribution of multiple symbols indicating the number of distinct sports events and the at least one sports team or player.

As noted above, the content of symbols in the third region may be universal if the outcomes selected in region two are identical (e.g., specific team, or games between specific teams) so that a random distribution of same statistical outcomes (e.g., one team winning by stated number of points) can be used. The winning point spread can be fairly applied by always printing symbols with the favored team first (whatever the point spread), or by randomly combining hidden points spreads with both positive and negative spreads shown (e.g., +3 or −17) and that spread applied to the first teams in the game, or to the single team revealed from exposing a symbol in the second region.

Otherwise, as implied above in the discussion of the second region, there may be multiple columns, with each column dedicated to or overlapping with positions (e.g., all of QBs, running backs and receivers can use total yards offense as a parameter from the third region). Otherwise there would be a QB column, an RB column, a Receiver column, a kicker column, etc. so that any category within the second region will have at least one column with a rational statistic for that position. For example, the kicker position for a team would not have a total yardage in offense statistic available, but might have total yards for field goals, total yards punted, total number of punts, etc.

Each of the three distinct regions of images has an opaque scratch-off coating over the images, and each of the three regions have visually distinct opaque scratch-off coatings so that each one of the multiple symbols within the three distinct regions has a distinct area over each of the multiple symbols within the three distinct regions, so that individual ones of the multiple symbols can be scratched-off without exposing unintended numbers of the multiple symbols when scratching-off only one intended distinct area of a coating to expose only a single one of the multiple symbols at a single time.

The gaming elements of the present invention have a high degree of flexibility in applications to various sports, levels of sports, regions for sports and the like. The card will be discussed primarily with regard to football, as that is where the biggest active group of players is involved in regular fantasy football play. However, the game is equally applicable to most other sports such as soccer (football), baseball, basketball, tennis, golf and the like, and is playable using one or more levels of play, such as professional sports, amateur sports, international competitions, college sports, women's sports, men's sports and the like. Players tend to prefer that each fantasy event is focused on a single level of play, but because the present wagering game is random, the different levels of play, even if in the same sport, can be easily combined.

Reference to the Figures can assist in a further appreciation of elements of the present invention.

FIG. 1 is a full face view of a fantasy sport gaming ticket 10 according to the present technology before any opaque covering has been removed. The gaming ticket 10 is shown with a paper stock base 12 and a first region 14 having four distinct scratch-off areas 16 under which would be random numbers of events/games/players/statistic to be chosen from other regions. The underlying random numbers would of course be opaque. When one (and only one) of the areas 16 are scratched, the underlying number (not shown) is exposed. By way of example, revelation of the number three (3) will be used for an explanation of events. After the number three (3) has been exposed by scratching-off only the single symbol 3 (which could be as a symbol, 3, III, three, three dots, etc.), the ticket user must then scratch off exactly three specific event/player/game/statistic areas 20 within the second region 18. The use of this specific ticket and events will be examined with respect to professional NFL Football for a week of play. As the schedule is known well in advance of each week, tickets listing specific team vs team games can be printed out in advance. The individual actual games randomly underneath the scratch-off areas 20 will be randomly distributed and although some cards will repeat the random distribution, in the card shown, there could be 16! (sixteen factorial) distributions of games available in random distributions within the totality of tickets printed. Therefore, if the Green Bay Packers are playing at the Minnesota Vikings, that specific game could be in anyone of the sixteen different scratch-off areas shown in the second region. The ticket user would have to scratch off exactly three of the opaque coatings over the areas 20 to meet the requirements established by scratching-off three (3) in the first region.

Generally, if the third area in the top row, the second area in the third row, and the fourth area in the fourth row were revealed by removing the opaque covering, the game events being evaluated on this ticket 10 would be nominally referred to as Game 1 (the third area in the top row), Game 2 (the second area in the third row), and Game 3 (the fourth area in the fourth row). This nominal reference becomes important with respect to determining the actual statistic associated with each Game (1, 2 and 3) by scratching-off statistics areas 24 in the third region 22.

In the third region 22, again exactly three (3) statistics areas 24 must be scratched off to reveal a statistic hidden underneath the masked statistics areas 22. The row by column nominal listing of the statistical areas 24 will again be determined by which areas and in what final order areas 24 have been revealed. This can give a player some feel for control of activity and input into the ticket. For example, if the games revealed were Game 1, GB v Minnesota (official spread GB +5); Game 2 was Tennessee v NO (official spread +13) and SF v Cleveland (official spread +9), if the ticket user's first statistic scratch off (taking the eighth area 24 in the column and row order) and reveals a statistic of +5, the player may want to assure that specific pick to be applied to Game 2 where the random statistic +5 is well within the "official" spread, making that a high likelihood winning outcome. To assure that association of +5 in Game 2, the ticket user would then scratch-off and reveal only one earlier area 24 (e.g., any one of areas 1, 2, 3, 4, 5, 6 or 7 to be associated with Game 1) and only one later area 24 (9, 10, 11, 12, 13, 14, 15 or 16 to be associated with Game 3). Further ticket user input could occur if, for example, when revealing an area 24 expected to be associated with Game 1, a statistic of 300 yards combined rushing is revealed and both of these teams are believed to be highly pass oriented. The ticket user could then alter the strategy of scratching-off the third area 24 and hope to shift the second statistic picked (300 yds total rushing) to the GB v Minnesota game by making the third scratch-off earlier in the nominal listing of statistical events than the actual second pick to shift the second pick (300 yds) to the GB v Minnesota game and the +5 to the SF v Cleveland game where the +5 is still valuable.

Because of the randomness of the actual event pick and the ability of the random statistics events to be weighted in the printing process, there can be a house advantage printed into the tickets. For example, the tickets can be printed with the line-favored team always being first in the listed game. The statistics areas 24 could then have a significant portion (e.g., 25%) as negative spreads (first team loses by 6+ points, stated as −6). This would weight the statistics towards losing outcomes, as the favored team must lose by at least the stated number of points. If the favored team won, or lost by fewer points than the target number, the outcome would be a loss.

The third region 26 of the ticket 10 shows three types of additional security that may be present (one or more) on the cards. A QR code box 32, a bar code 30 and an alphanumeric code 28 are shown on the ticket. When a ticket is redeemed, one or more of the code boxes can be used to verify the card.

Figure 2:
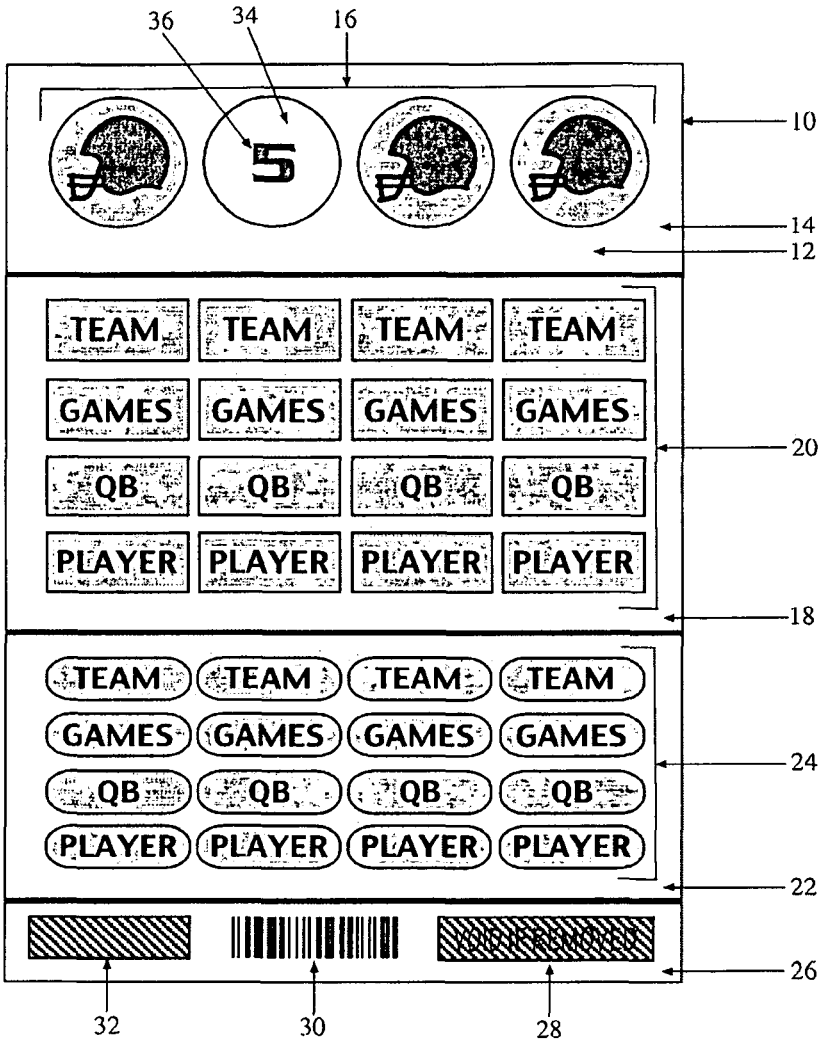
FIG. 2 is a full face view of a fantasy sport gaming ticket according to the present technology when a single class of opaque covering has been removed.

FIG. 2 is a full face view of a fantasy sport gaming ticket 10 according to the present technology when a single class of opaque covering has been removed 34 from region 14 revealing an indicator of a number of events on which the ticket 10 must be engaged. The revealed number (5) in the ticket 10 indicates the number of specific events (selected from TEAM, GAMES, QB and PLAYER) which must be selected from the field 20 to activate the ticket 10. The activation of the special events in field 20 is shown in FIG. 3.

Figure 3:
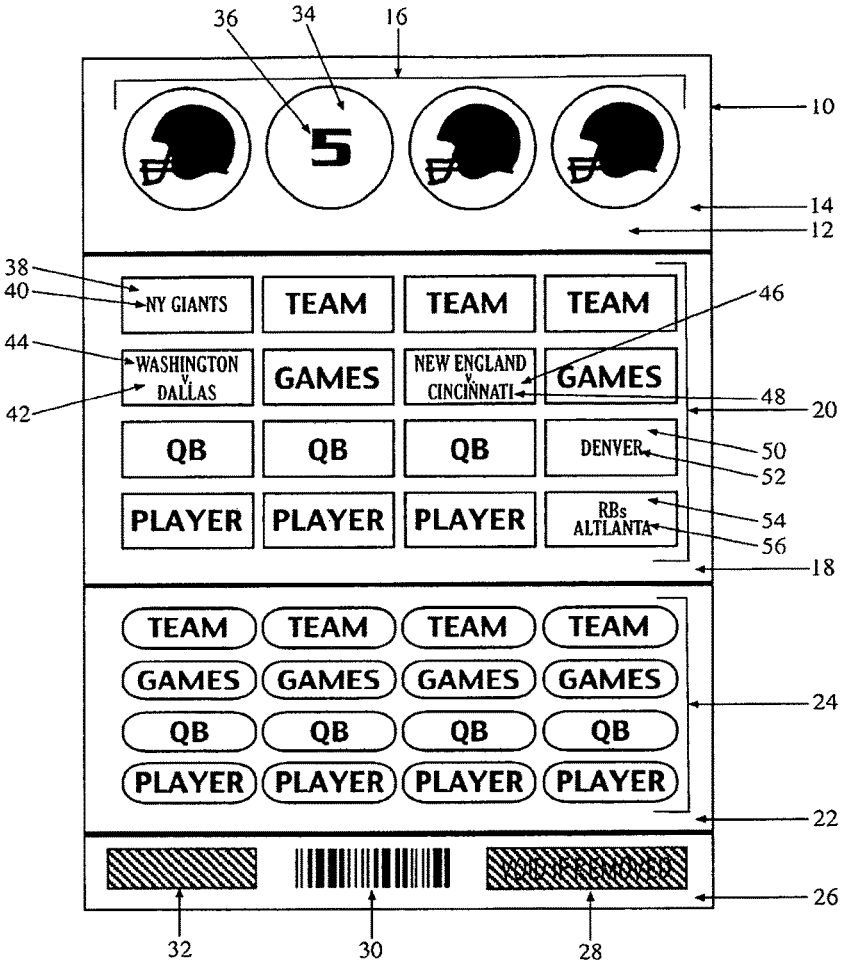
FIG. 3 is a full face view of a fantasy sport gaming ticket according to the present technology when a second class of opaque covering has been removed in response to the single class of opaque covering has been removed according to FIG. 2.

FIG. 3 is a full face view of a fantasy sport gaming ticket 10 according to the present technology when a second class of opaque coverings has been removed (38, 42, 46, 52 and 54) in response to the single class of opaque covering has been removed 34 revealing 5 required event picks according to FIG. 2. As can be seen each revealed opaque coverings has been removed (38, 42, 46, 52 and 54) to respectively reveal a specific type of game event or statistical category (selected from TEAM, GAMES, QB and PLAYER, here 40, 44, 48 and 56) which the ticket user has elected to engage in with an active ticket. These game events (40, 44, 46, 48, 52 and 56) respectively are shown to represent a single TEAM (NY GIANTS 40), two games (Washington v. DALLAS 44 and New England V. Cincinnati 48), one Quarterback (QB, Denver 52) and one PLAYER (RB Atlanta 56). The quarterback and RB are illustrated with team names to adjust for injuries, roster changes and the like which might automatically make a selection a loss. It is possible to put specific player names in these fields, but the illustration shown provides a specific format which is most fair to ticket users.

Figure 4:
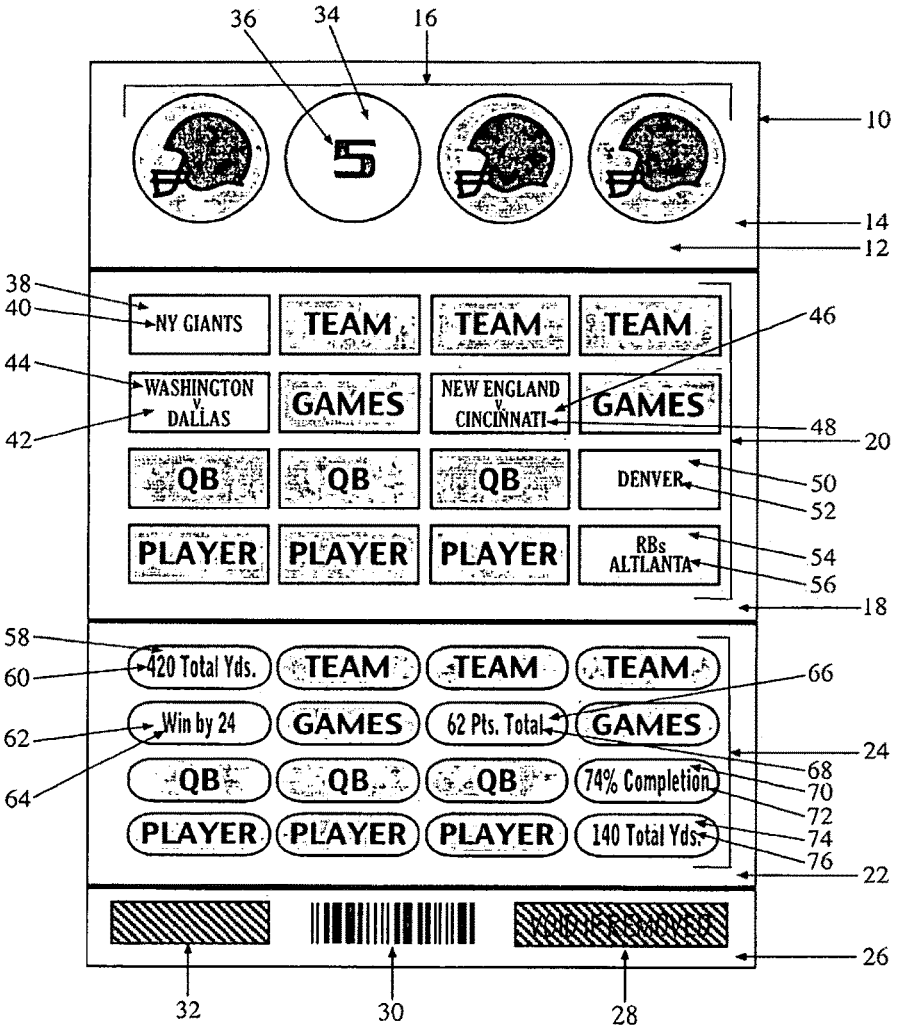
FIG. 4 is a full face view of a fantasy sport gaming ticket according to the present technology when a second class and third class of opaque covering has been removed in response to the single class of opaque covering has been removed according to FIG. 2.

FIG. 4 is a full face view of a fantasy sport gaming ticket 10 according to the present technology when a second class 20 and third class 22 of opaque covering has been removed in response to the single class of opaque covering 14 that has been removed according to FIG. 2. The revelation of the five (5) game events (40, 44, 46, 48, 52 and 56) respectively, which have been shown to represent a single TEAM (NY GIANTS 40), two games (Washington v. DALLAS 44 and New England V. Cincinnati 48), one Quarterback (QB, Denver 52) and one PLAYER (RB Atlanta 56) must then be associated with specific relevant statistical targets for the ticket by revelation of five (5) statistical targets from the third field 22. This is accomplished by scratching off opaque covering layers from five statistical areas 58, 62, 66, 68 and 72) corresponding to the five classes of the five (5) game events 40, 44, 46, 48, 52 and 56) respectively, which have been shown to represent a single TEAM (NY GIANTS 40), two games (Washington v. DALLAS 44 and New England V. Cincinnati 48), one Quarterback (QB, Denver 52) and one PLAYER (RB Atlanta 56). This is done by scratching off a single TEAM statistical event to represent the (NY GIANTS 40) game event, two GAMES statistical events top represent the two games (Washington v. DALLAS 44 and New England V. Cincinnati 48), one Quarterback statistical event to represent the QB event (QB, Denver 52) and one statistical PLAYER target to correspond to the single PLAYER game event (RB Atlanta 56). As previously indicated, where a multiple of GAME events have been selected (e.g., Washington v. Dallas 44 and NE v. Cincinnati 48), two statistical GAMES events must be selected and (for purposes of illustration) the order of the statistical GAMES events are conveniently associated in the same order as the GAMES events selected. In this instance, the matching of GAMES and Statistical GAMES events would be 44 paired with 64 and 46 paired with 66, so that Washington must win by at least 24 points for that combined pair of revealed GAMES indicators 44-64 is a win, and NE and Cincinnati must have a combined total points scored of at least 62 for that paired set of GAMES events 46-66 to be a winning outcome on the ticket.

Determining awards amounts and verifying tickets is simple using any of the security features 28, 30 and 32. These security features need not be covered with scratch off coatings, but may be to enhance security against internal security breaches. When the tickets are printed, the content of the number indicators 16, the GAMES events 18 and the statistical GAMES targets 22 are known and associated with the specific security features (readable codes). The revealed printed matter can be visually read or scanned by a reader, along with the security codes, and the resolution of the individual and collective combined GAMES events and GAMES targets can be determined. When an improper number of revealed data positions has been detected, the ticket is voided (if too many positions are revealed) and rejected for further scratch-off if too few are detected.

A preferred way of reading the scratched off tickets is by scanning the scratched-off ticket and: 1) determining the number of events that must be determined by scanning for the particular space revealed 9 with its known number, or even better, by scanning for the fact of a space having been revealed and determining the specifics of that space by determining which spaces haven't been scratched off). This is preferred as a scanner can more easily detect a specific position unmarked/undisturbed coating than reading a poorly or incompletely scratched-off area. 2) After the number of events required by the revealed scratched-off area in the Numbers field 14, the GAMES event field is read (simultaneously or sequentially) to determine how many and which GAMES events have been revealed. This again can be done by reading scratched-off areas or by reading the fact of a number of areas having been scratched-off and then determining which areas have not been scratched-off. 3) 2) After the number and specifics of GAMES events required by the revealed scratched-off area in the Numbers field 14 and 18, the GAMES statistical field is read (simultaneously or sequentially) to determine how many and which GAMES statistical events have been revealed. This again can be done by reading scratched-off areas or by reading the fact of a number of areas having been scratched-off and then determining which areas have not been scratched-off. Once the game outcomes have been determined, a central processor provides the statistical data necessary for resolution of the individual events, and resolution of the ticket is then done against a paytable based on the number (e.g., at least 3) and degree (e.g., 3/4, 6/8, etc.) of winning events/games that are revealed on the ticket.

Figure 2A:
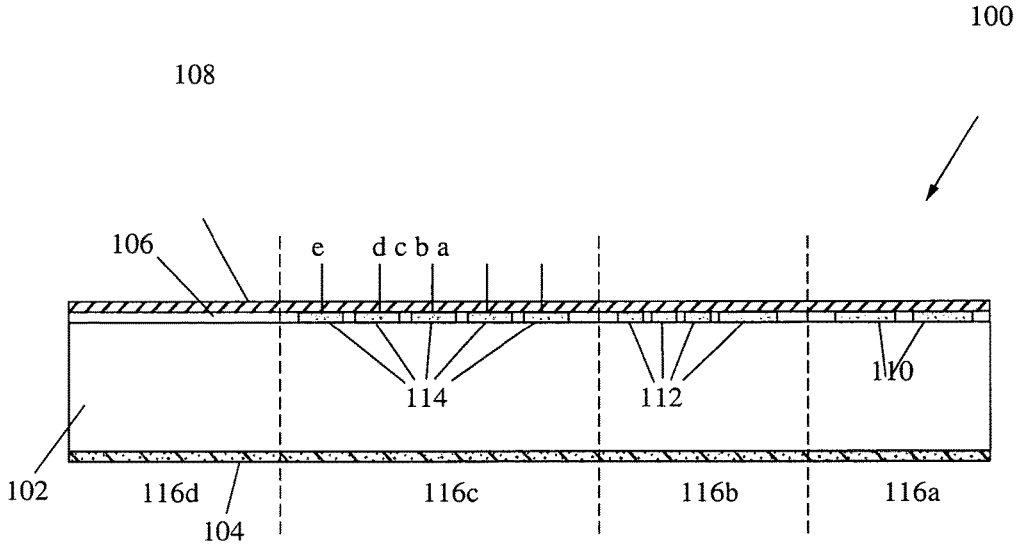
FIG. 2A is a cross-section view of a fantasy sport gaming ticket according to the present technology before any opaque covering has been removed.

FIG. 2A is a cross-section view of a fantasy sport gaming ticket 100 according to the present technology before any opaque covering has been removed. The ticket 100 is shown with four regions 116*a*, 116*b*, 116*c*, and 116*d*, respectively showing the number of events zone 116*a*, the specific events/player/team 116*b*, the statistical challenge event 116*c* and the security region 116*d*. In the first region 116*a* there is shown two rows 110 of numbers of events. The opaque layer 108 over the printed layer 106 may be continuous (with visually observable definition of the specific scratch-off areas provided within that opaque layer 108, e.g., by different color content or outlining over each distinct area 110 within the rows and columns) or may be discontinuous, with opaque paint, wax, coating, overlay covering only the printed content 110, 112, and 114 in the printed layer 106.

The game event printed content in columns and rows 112 for the second region is shown. The statistical challenge printed content 114 is shown in the third region 116*c*. A radiation transmission resistant backing layer 104 (e.g., carbon black or aluminum particle filled layer) on the back surface of the paper stock layer 102 can be provided to assure that imaging techniques (IR, ultrasound, UV, etc.) cannot be used to attempt to visualize the printed content before scratch-off takes place.

The ticket 10 may be comprised of a substrate upon which data is imaged, this data being randomly distributed even though predetermined and fixed in nature, for example the specific competing teams, the specific single team, a specific player, a specific position on a team, etc. The ticket 10 is printed in known fashion using the known types of inks, and includes a removable (e.g., latex) or other polymer scratch-off layer (such as removable coverings 108) which overlies and securely conceals the variably imaged data, this scratch-off layer being comprised of known types of soft coverings including elastomeric coatings. The opaque covering or coating 108 may be an opaque coating or paint opaque ink, opaque UV-cured ink or elastomer. As known in the art (e.g., U.S. Pat. No. 4,591,190), the indicia may be applied to the ticket using xerographic (or bubble, or ink jet, or gravure printing) and the release coating may applied to the ticket using (as a non-limiting preference) flexographic printing or screen printing and may be comprised of an ultraviolet-cured ink and the scratch-off coating may be applied to the ticket using letterpress printing and may be comprised of an ultraviolet-cured ink, IR-dried/cured ink, or air dried or oven-dried ink.

A significant part of practicing the methods of the present invention with the ticket of the present invention is the ability and necessity of reading the tickets, determining winning and losing outcomes and maintaining a significant degree of security in the use of the tickets. The present ticket can be used with a method that facilitates each of these needs.

Each ticket is printed with a combination of specific ticket identifier (in the code area) and a specific combination of distributed numbers (in the first area), game events (e.g., Teams, Games, Players) and statistical targets (e.g., Team statistics, Game statistics and Player statistics). As the combination of numbers and specific distributions of events and targets is "known" within the system, once the actual sports event results are known, a central processor can determine what specific combinations of numbers, events and statistical targets are winning outcomes. For example, with a number 1 being selected in the first field, there might be 1, 2, 3, 4, 5 or more combinations of different single events and different single statistics that can be winning events. Similarly, with a number 5 being selected, there might be multiple combinations of 4 or five pairs of event and statistical targets that can be combined to provide a winning ticket. All of these winning combinations are "known" by the computer after input of actual sports outcomes are entered into memory. The reading of the ticket is therefore used to determination of whether winning combinations of numbers of games, events and statistical targets have been revealed that equate to a winning outcome. It is therefore not necessary to read actual numbers, events and statistical targets, but rather to determine only combinations of number positions, event positions, and statistical target positions that equate to a "known" winning or losing combination.

The reading system is therefore used in a best operational format according to the following events.

Knowledge of all relevant actual game outcomes (for a day or week or other time interval), and all statistical targets used in the game system within those game outcomes is stored in a central processor. Distribution of all numbers, games and statistical targets for tickets with unique ticket identifiers are stored in memory in a central or accessible processor. After a ticket user has scratched off a single number region and sufficient events (games, teams and/or players) and statistical targets to satisfy (but not exceed) the number requirement, the position of scratched areas and regions must be read. After reading (see the next section on reading functionality) the spaces that have been exposed/scratched, the read positions for the uniquely identified ticket are compared with the possible combinations of winning outcomes for that uniquely identified ticket, and a win/loss determination is made by the central processor. The determination is based on the actual exposed/scratched off areas on the uniquely identified ticket matching a combination of number, events and statistical targets known in memory to determine a win/loss outcome.

Reading functionality for the revealed areas in the scratched-off tickets can be formed by a number of methods, from actual high quality imaging of the ticket face (e.g., 256×256 pixels to 1024×1024 pixels or higher) to simple spatial recognition of scratched off and non-scratched off areas within the first and second, or first second and third regions. By reading the spatial distribution of at least scratched-Off areas, and preferably (if not essentially) also non-scratched-off areas (to assure that all areas or excessive numbers of areas have not been scratched off to reveal all possible winning [and losing] combinations). The tickets may have alignment markings or registration marks on the content side of the ticket so that if a ticket is not aligned properly within a reading system, the registration marks can be used to virtually align the ticket face for purposes of assuring that revealed/scratched-off/exposed areas and unscratched-off areas are properly read and identified. When tickets are cashed in, visual inspection should be used to confirm scratched-off areas and to assure that attempts have not been made to scratch areas and replace removed coatings.

The reading functionality may be used in combination with specific inks and colors and coatings so that accurate and secure reading of scratched-off areas is provided. The reading may be done with ambient light, projected infrared radiation, projected visible light, projected ultraviolet radiation or combinations of these. The inks and/or coating compositions may be designed to enhance or even enable reading by the image capture/scanning reader for the ticket to determine winning/losing outcomes.

Typically, the coatings on scratch-off tickets are silver/metallic in color and made from elastomeric material or other polymeric material that forms continuous films that are disruptable by abrasion, and disruptable without removing all of the film when continuity of the film is breached. The film may contain pigments (including metallic particles or flakes) that are highly reflective or highly absorptive of specific ranges of radiation that is being used to read the ticket. IR-absorbing pigments/dyes, visible color-absorbing pigment/dyes, UV-absorbing pigments/dyes may be used in or on the coating material (and different or complementary colors may be used under the coatings). By using contrasting complementary colors (e.g., colors opposite each other on the color wheel such as red-green, yellow-purple, orange-blue), the contrast between the colors is enhanced and the ability of the reader to differentiate between scratched-off/revealed areas and unscratched/unrevealed areas is magnified. The coating may also be highly reflective of any and all radiation and light (e.g., metallic pigments or flakes) and the base of the ticket may be highly absorptive of any and all radiation (e.g., blends of all color pigments, black pigments and/or carbon black pigments).

Many variations within the generic scope of the present invention can be practiced. For example, the events or the statistical targets may be wild cards or free rides, so that revealing a wild symbol makes one selection (in a card with a number and one area only to reveal or even where there is a number and two areas of event and statistical target to reveal) a single automatic winning outcome. A revealed number can offer a player selection of numbers, such as revealing a "4/5" with which a player may scratch of the lesser number (4) and determine if a winning outcome has been achieved and then choose another set of event and statistical target to increase a potential size of an award, or if after selecting "4" there are only 3 winning combinations (which may be a low paying win or a non-winning outcome) and wants to try for 4-out-of-5 outcome which would pay higher awards.

To facilitate reading partially scratched-off areas, coatings/pigments/dyes can be printed/coated under the coating which are particularly sensitive to the electromagnetic radiation to which the scanner/reader/imaging system is most sensitive when reading areas that have been revealed. In this way, even the slightest coating removal can be enough to be automatically read by equipment.

In the use of only the two scratch-off areas (e.g., numbers area and event+statistic areas), the ticket would have an appearance like that of FIG. 1 and not have a third scratch-off area.

Although individual games/teams/events scratched off have been shown to be random within a complete sport and time period (e.g., week 7 NFL football, week 6 US College Football, week 22 American Conference baseball, week 12 NBA, etc.), tickets may be printed with further nominal limitations to satisfy local or regional players. For example, a ticket may have a non-scratch-off title such as Eastern NFL conference week 7, SEC Football week 4, Eastern Conference NHL week 11, and the like.

What is claimed:

1. A scratch-off fantasy sport gaming ticket comprising:

a) a ticket support sheet;

b) three distinct regions of images on one side of the ticket support sheet;

c) a first region of images providing a random distribution of multiple symbols indicating a single number of distinct sports events on which the ticket can be used, wherein selection of a single number as the number of distinct sports events on which the ticket can be used establishes that single number as a limiting number on numbers of symbols that may be selected in both a second region and a third region;

d) the second region of images providing a random distribution of multiple symbols indicating at least one sports team or player on which the ticket can be used in combination with the limiting number of distinct sports events selected in c);

e) third region of images providing a random distribution of multiple symbols indicating a sports statistic to be associated with both the random distribution of multiple symbols indicating the limiting number of distinct sports events selected in c) and the at least one sports team or player; and wherein each of the three distinct regions of images have an opaque scratch-off coating over them, and each of the three distinct regions of images have visually distinct opaque scratch-off coatings so that each one of the multiple symbols within the three distinct regions has a distinct area over each of the multiple symbols within the three distinct regions, so that individual ones of the multiple symbols can be scratched-off without exposing unintended numbers of the multiple symbols when scratching-off only one intended distinct area of the opaque scratch-off coating to expose only a single one of the multiple symbols at a single time; and wherein data provided from game outcomes are compared to the number of at least one sports team or player selected from the second region with respective data from game outcomes on sports statistics associated with the at least one sports team or player from the third region, and determination of an outcome number of combinations of second region and third region selections correctly matching the data from the game outcomes is used against a paytable to determine a size of an award.

2. The ticket of claim 1 wherein the one side of the ticket has visual symbols indicating a single specific type of sport event to which the ticket is relevant, and the visual symbols indicating the specific type of sport event are not removed during scratching off of opaque scratch-off coatings over distinct area over each of the multiple symbols within the three distinct regions.

3. The ticket of claim 1 wherein the first region of images comprises at least four different areas with random numbers covered by the opaque scratch-off coatings.

4. The ticket of claim 1 wherein the second region of images comprises at least ten different areas with random numbers covered by the opaque scratch-off coatings.

5. The ticket of claim 1 wherein the third region of images comprises at least eight different areas with random numbers covered by the opaque scratch-off coatings.

6. The ticket of claim 3 wherein the second region of images comprises at least ten different areas with symbols indicating at least one sports team or player covered by the opaque scratch-off coatings.

7. The ticket of claim 6 wherein the third region of images comprises at least eight different areas with symbols indicating a sports statistic to be associated with both the random distribution of multiple symbols indicating the limiting number of distinct sports events selected in c) covered by the opaque scratch-off coatings.

8. The ticket of claim 4 wherein the third region of images comprises at least eight different areas with symbols indicating a sports statistic to be associated with both the random distribution of multiple symbols indicating the limiting number of distinct sports events selected in c) covered by the opaque scratch-off coatings.

9. A scratch-off fantasy sport gaming ticket comprising:

a) a ticket support sheet;

b) two distinct regions of images on one side of the ticket support sheet;

c) a first region of images providing a random distribution of multiple symbols indicating a single specific whole integer number of distinct sports events on which the ticket can be used, which single number is a limiting number on numbers of symbols that may be selected from a second region;

d) a second region of images providing a random distribution of multiple symbols indicating both A) at least one sports team or player on which the ticket can be used in combination with the number of distinct sports events and B) a sports statistic to be associated with the one sports team or player; and wherein each of the two distinct regions of images have an opaque scratch-off coating over them, and each of the two distinct regions of images have visually distinct opaque scratch-off coatings so that each one of the multiple symbols within the two distinct regions has a distinct area over each of the multiple symbols within the two distinct regions, so that individual ones of the multiple symbols can be scratched-off without exposing unintended numbers of the multiple symbols when scratching-off only one intended distinct area of the opaque scratch-off coating to expose only a single one of the multiple symbols at a single time, and wherein data provided from game outcomes are compared to the number of the at least one sports team or player selected from the second region with respective data from game outcomes on sports statistics associated with the at least one sports team or player from the second region, and determination of an outcome number of combinations within the second region and third region selections correctly matching the data from the game outcomes is used against a paytable to determine a size of an award.

10. The ticket of claim 9 wherein the one side of the ticket has visual symbol indication of a single specific type of sport event to which the ticket is relevant, and that visual symbol indication is not removed during scratching off of opaque scratch-off coatings over distinct areas of each of the multiple symbols within the two distinct regions.

11. The ticket of claim 9 wherein the second distinct region contains at least two distinct areas having within each distinct area combinations of events and statistics selected from the group consisting of a team and total score in a game for that team; a team and total touchdowns for that team in a game; a team and total rushing touchdowns for that team in a game; a team and total passing touchdowns for that team in a game; a team and total field goals for that team in a game; a quarterback and total touchdowns by that quarterback in a game; a quarterback and total passing yards for that quarterback in a game; a running back and total touchdowns for that running back in a game; a running back and total yards fir that running back in a game; a running back and total yards for that running back in a game; a pair of teams in a game with a point spread difference between the two teams in that game; a pair of teams in a game and a total point count for the two teams in that game; a pair of teams in a game and a total number of touchdowns scored for the two teams in that game; a pair of teams in a game and a total number of rushing touchdowns scored for the two teams in that game; a pair of teams in a game and a total number of passing touchdowns scored for the two teams in that game; and a pair of teams in a game and a total number of kicking points scored for the two teams in that game.

12. A method of executing a wagering event on a scratch-off fantasy sport gaming ticket comprising providing a sports fantasy ticket comprising:

a) a ticket support sheet;

b) three distinct regions of images on one side of the ticket support sheet;

c) a first region of images providing a random distribution of multiple symbols indicating a single number of distinct sports events on which the ticket can be used, wherein selection of a single number as the number of distinct sports events on which the ticket can be used establishes that single number as a limiting number on numbers of symbols that may be selected in both a second region and a third region;

d) the second region of images providing a random distribution of multiple symbols indicating at least one sports team or player on which the ticket can be used in combination with the limiting number of distinct sports events selected in c);

e) third region of images providing a random distribution of multiple symbols indicating a sports statistic to be associated with both the random distribution of multiple symbols indicating the limiting number of distinct sports events selected in c) and the at least one sports team or player; and wherein each of the three distinct regions of images have an opaque scratch-off coating over them, and each of the three distinct regions of images have visually distinct opaque scratch-off coatings so that each one of the multiple symbols within the three distinct regions has a distinct area over each of the multiple symbols within the three distinct regions, so that individual ones of the multiple symbols can be scratched-off without exposing unintended numbers of the multiple symbols when scratching-off only one intended distinct area of the opaque scratch-off coating to expose only a single one of the multiple symbols at a single time; and wherein data provided from game outcomes are compared to the number of at least one sports team or player selected from the second region with respective data from game outcomes on sports statistics associated with the at least one sports team or player from the third region, and determination of an outcome number of combinations of second region and third region selections correctly matching the data from the game outcomes is used against a paytable to determine a size of an award, the method comprising:

f) scratching-off only a single area of a visually distinct opaque scratch-off coating over a single random symbol in the first distinct region to provide an operative random number determining a totality of events to be active on the gaming ticket;

g) scratching-off a number of single areas of a visually distinct opaque scratch-off coating in the second distinct region, the total number of single areas scratched-off in the second distinct region being exactly equal to the operative random number to determine teams, games, players, or events to be active on the gaming ticket;

h) scratching-off a number of single areas of a visually distinct opaque scratch-off coating in the third distinct region, the total number of single areas scratched-off in the third distinct region being exactly equal to the operative number to determine respective statistical outcomes to be associated with the respective teams, games, players, or events to be active on the gaming ticket; and then comparing the active respective statistical outcomes associated with the respective teams, games, players, or events with actual sports event outcomes that provide the statistical outcomes associated with the respective teams, games, players, or events in actual sports event outcomes; and providing an award to a ticket user against a paytable when the comparison shows at least a minimum degree of correspondence between revealed statistical outcomes associated with the respective teams, games, players, or events with actual sports event.

13. A method of executing a wagering event on the scratch-off fantasy sport gaming ticket of claim 9 comprising:

e) scratching-off only a single area of a visually distinct opaque scratch-off coating over a single random symbol in the first distinct region to provide an operative random number determining a totality of events to be active on the gaming ticket;

f) scratching-off a number of single areas of a visually distinct opaque scratch-off coating in the second distinct region, the total number of single areas scratched-off in the second distinct region being exactly equal to the operative random number to determine teams, games, players, or events to be active on the gaming ticket; and providing an award to a ticket user against a paytable when the comparison shows at least a minimum degree of correspondence between revealed statistical outcomes associated with the respective teams, games, players, or events with actual sports event.

14. The method of claim 13 wherein knowledge of all relevant actual teams, games, players or event outcomes used for the gaming ticket and all statistical targets used in the game system within those relevant event outcomes is stored in a central processor, distribution of all numbers, events and statistical targets for tickets with unique ticket identifiers are stored in memory in a central or accessible processor, after a ticket user has scratched off a single number region to reveal the operative random number and sufficient events and statistical targets to satisfy but not exceed the operative number, the position of scratched areas and regions are read, and then after reading the position of scratched areas, the read positions of scratched areas for the uniquely identified ticket are compared with possible combinations of winning outcomes for that uniquely identified ticket, and a win/loss determination is made by the central processor.

15. The method of claim 12 wherein knowledge of all relevant actual teams, games, players or event outcomes used for the gaming ticket and all statistical targets used in the game system within those relevant event outcomes is stored in a central processor, distribution of all numbers, events and statistical targets for tickets with unique ticket identifiers are stored in memory in a central or accessible processor, after a ticket user has scratched off a single number region to reveal the operative random number and sufficient events and statistical targets to satisfy but not exceed the operative random number, the position of scratched areas and regions are read, and then after reading the position of scratched areas, the read positions of scratched areas for the uniquely identified ticket are compared with possible combinations of winning outcomes for that uniquely identified ticket, and a win/loss determination is made by the central processor.

16. The method of claim 12 wherein the scratch-off coating contains pigments which are highly reflective of radiation which is used by an image capture system to read the ticket after areas have been scratched-off and wherein if more than a single area of a visually distinct opaque scratch-off coating over a single random symbol in the first distinct region is scratched off, or if more than the operative random number of areas in the second distinct region is scratched off, or if more than the operative random number of areas in the third distinct region is scratched off, the sport gaming ticket is void.

17. The method of claim 13 wherein the scratch-off coating contains pigments which are highly reflective of radiation which is used by an image capture system to read the ticket after areas have been scratched-off.

18. The method of claim 15 wherein the scratch-off coating contains pigments which are highly reflective of radiation which is used by an image capture system to read the ticket after areas have been scratched-off.

19. The method of claim 16 wherein the scratch-off coating contains pigments which are highly reflective of radiation which is used by an image capture system to read the ticket after areas have been scratched-off.

20. The method of claim 12 wherein if more than a single area of a visually distinct opaque scratch-off coating over a single random symbol in the first distinct region is scratched off, or if more than the operative random number of areas in the second distinct region is scratched off, or if more than the operative random number of areas in the third distinct region is scratched off, the sport gaming ticket is void.

* * * * *